United States Patent [19]

Berdzar et al.

[11] 4,336,591

[45] Jun. 22, 1982

[54] MAXIMUM DEPTH MONITORING APPARATUS

[75] Inventors: Peter F. Berdzar, Ramona; Robert S. Acks, San Diego, both of Calif.

[73] Assignee: The United States of America as represented by the Secretary of the Navy, Washington, D.C.

[21] Appl. No.: 166,413

[22] Filed: Jul. 7, 1980

[51] Int. Cl.[3] ..... G06F 15/42

[52] U.S. Cl. ..... 364/418; 73/291

[58] Field of Search ..... 364/415, 418, 558; 73/432 R, 291, 300; 235/92 MT, 92 T; 128/204.23, 205.23, 905; 340/384 R

[56] References Cited

U.S. PATENT DOCUMENTS

| | | | |
|---|---|---|---|
| 3,992,948 | 11/1976 | D'Antonio et al. | 364/418 |
| 4,005,282 | 1/1977 | Jennings | 364/418 |
| 4,054,783 | 10/1977 | Seireg et al. | 364/418 |
| 4,109,140 | 8/1978 | Etra | 364/418 |
| 4,188,825 | 2/1980 | Farrar | 364/418 |
| 4,192,001 | 3/1980 | Villa | 364/418 |

FOREIGN PATENT DOCUMENTS

| | | | |
|---|---|---|---|
| 2385150 | 10/1978 | France | 364/418 |
| 1417823 | 12/1975 | United Kingdom | 364/418 |

*Primary Examiner*—Errol A. Krass

*Attorney, Agent, or Firm*—R. F. Beers; Ervin F. Johnston; James O. Skarsten

[57] ABSTRACT

A depth monitoring device monitors the period of a diver's maximum depth. A maximum depth display is coupled to the depth monitor to enable the diver to quickly determine, at any given time during the period, his maximum depth of submergence. When the diver reaches a preselected critical maximum depth, an audio alarm coupled to the depth monitor is activated to alert the diver.

5 Claims, 4 Drawing Figures

MAXIMUM DEPTH MONITORING APPARATUS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The invention disclosed and claimed herein generally pertains to the field of diving safety devices of the type which enable a diver to easily and continually keep track of his maximum depth of submergence. More particularly, the invention pertains to the field of devices of the above type which comprise solid state electronic components, to eliminate the need for periodic calibration. Even more particularly, the invention pertains to the field of devices of the above type which have the capability of warning the diver by means of an audio alarm that he has reached a critical maximum depth of submergence.

It is well known that diver safety is affected by two critical parameters, i.e., the length of time a diver has been submerged, or bottom time, and his maximum depth. According to standard practice of the U.S. Navy, a diver's maximum depth is taken to be the lowest level to which he has descended at any point during a dive, regardless of the amount of time he remains at such level.

The above two parameters are critical because, taken together, they determine whether or not a diver will have to make decompression stops at the conclusion of his dive, and if so, the respective levels and times of the decompression stops. Failure to adhere to a decompression schedule which is demanded by the combination of two particular values of bottom time and maximum depth can result in severe injury or death, due to the phenomenon known as "the bends". At the same time, a diver using SCUBA equipment (self contained underwater breathing apparatus) is severely constrained in the amount of time he may spend underwater, since his air supply is limited. Consequently, it may be of the utmost importance for a diver to keep track of his maximum depth, to avoid getting into a situation where the combination of his maximum depth and bottom time require him to make decompression stops for which he does not have sufficient air.

In the past, various types of pressure gauges and bathometers have been provided which enable a diver to see his current depth, at any point during a dive. Since a depth gauge provides only current depth information, a diver must continually check his depth gauge, and must somehow be able to record or remember the maximum depth shown. Because a diver usually is preoccupied by underwater tasks, continuous monitoring of a depth gauge may be virtually impossible. It is often difficult or impossible to record or to recall maximum observed depth, despite the critical importance of doing so.

In a patent to Jennings, U.S. Pat. No. 4,005,282, issued Jan. 25, 1977, a miniature computer is provided, which is programmed with depth, time and decompression relationships to provide a diver with information pertaining to a safe ascent. The Jennings system was developed as part of the continuing effort of the U.S. Navy to improve diver safety, and is considered to be a major achievement. However, since it is a computer device, it may be somewhat complicated, and comparatively expensive. Also, when the combination of a diver's depth and bottom time become such that the diver is placed in a potentially hazardous condition, the diver is alerted only by means of a small flashing light which might be completely missed by a working diver.

Thus, there is a continuing need in the state of the art for enhancing the safety of a diver by enabling him to rapidly determine, at any point during a dive and with minimal distraction, his maximum depth of submergence up to such point. Such a device should continually indicate a diver's maximum depth, eliminate the need for continuous monitoring, to have a maximum depth memory and provide an audio warning. Inexpensive solid state electronic components, eliminating the need for periodic calibration should be employed, and be arranged in either a wrist mounted mode or a mode mountable on a diver propelled vehicle (DPV).

SUMMARY OF THE INVENTION

The present invention provides diving safety apparatus which includes means for monitoring the maximum depth of a diver during the period that the diver is submerged in an underwater environment. The apparatus further includes indicating means coupled to the depth monitoring means for enabling the diver to readily determine, at any given time during the period, his maximum depth of submergence at any point up to the given time. An audio alarm is coupled to the depth monitoring means to insure that the diver is alerted when he decends below a particular critical maximum depth, even if he is preoccupied with various tasks.

Preferably, the depth monitoring means comprises solid state electronic components, and means are provided for monitoring the passage of time while the diver is submerged. Preferably also, display means are provided for enabling a diver to easily view his maximum depth and submergence time.

In a preferred embodiment, the depth and time monitoring means and the display means are contained in a package which is mountable upon a diver's wrist, in a manner which does not hinder underwater activities. The audio alarm for such embodiment comprises a bone conduction earphone, coupled to the depth monitoring means by means of a very thin conductor.

In an alternative embodiment, the depth and time monitoring means and display means are contained in a package which is mountable upon a diver propelled vehicle. The audio alarm for such embodiment comprises an acoustic projector, also mountable upon the vehicle, which is capable of projecting audio waves of sufficient strength to catch the diver's attention.

OBJECTS OF THE INVENTION

An important object of the present invention is to substantially improve diver safety by enabling a diver to keep much closer track of his maximum depth.

Another object is to alert a diver to a potentially hazardous situation by means of an alarm, such as an audio alarm, which is capable of instantly attracting a diver's attention when he is preoccupied with various underwater activities.

Another object is to enable a diver to simply and accurately keep track of his maximum depth and bottom time during the entire course of a dive.

Another object is to alert a diver to a potentially hazardous maximum depth situation when the diver is preoccupied with the operation of a diver propelled vehicle.

Another object is to provide apparatus for accomplishing the above purposes which is formed of solid state electronic components to avoid the need for calibration, and which is comparatively simple and inexpensive.

Another object is to provide an apparatus of the above type which allows the depth at which an audio alarm is to be activated to be conveniently selected just prior to a dive.

These and other objects of the invention will become more readily apparent from the ensuing specification when taken together with the drawings.

DETAILED DESCRIPTION OF THE PREFERRED EMBODIMENT

Figure 1:
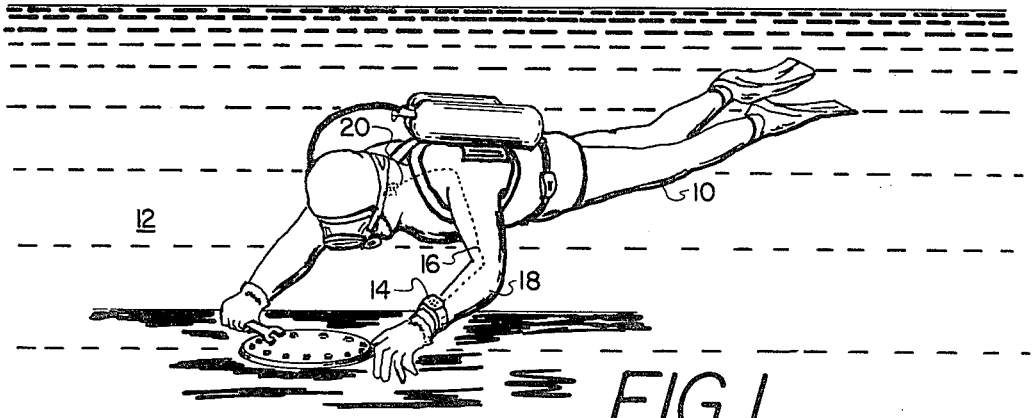
FIG. 1 is a perspective view which shows a diver employing an embodiment of the invention in an underwater environment.

Referring to FIG. 1, there is shown a diver 10 performing certain work tasks in an underwater environment 12, at a working depth such as 50 feet. As a general rule of diver safety, if the diver does not descend below such depth, he can continue underwater activities for a period of up to 100 minutes, and then immediately ascend to the surface without having to make any decompression stops. However, if the diver descends to a lower depth, his allowable bottom time may be substantially reduced. For example, if he descends to 70 feet, even momentarily, the safety rules permit him to stay down for only 50 minutes, if he is to surface without decompression stops.

In order to prevent the diver from descending below his working depth of 50 feet, and also to alert him in the event that he does, diver 10 is equipped with a wrist mountable gauge 14, hereinafter described in greater detail. A lead 16 runs beneath the diver's wet suit 18 to a bone conduction earphone 20, positioned behind the diver's ear adjacent to his mastoid bone. Lead 16 need comprise only a very thin, flexible wire so that its presence beneath the diver's wet suit is in no way disturbing to the diver. When a depth sensor included in gauge 14 detects that the diver has descended below 50 feet, a signal is coupled through lead 16 to activate bone conduction phone 20, alerting diver 10. Phone 20 may comprise any of a number of bone conduction devices which are well known among divers, and may be comparatively inexpensive, since fidelity of the phone is unimportant for the above application.

It is anticipated that other audio or skin vibrational equipment with which a diver may be provided could be substituted for phone 20 to alert the diver that he has exceeded a preselected depth limit.

Figure 2:
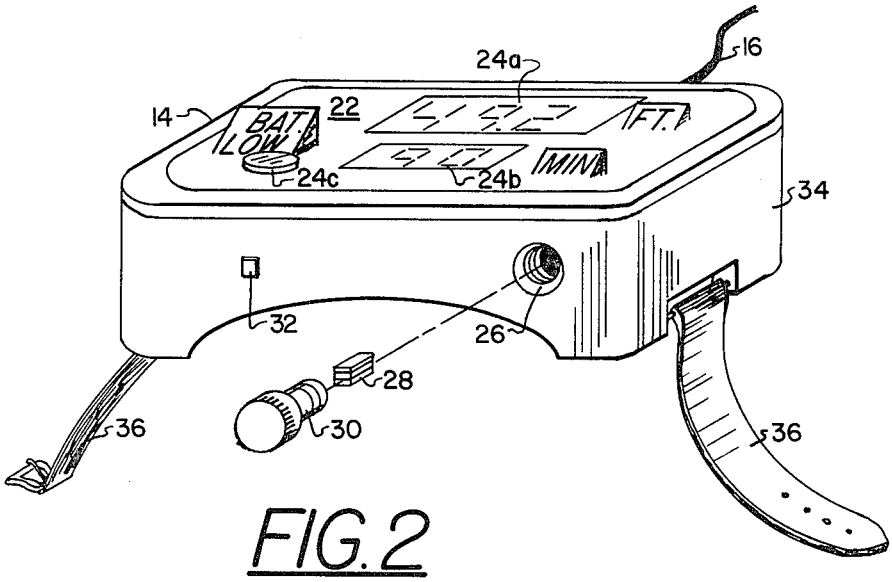
FIG. 2 is a perspective view showing a wrist mountable gauge for the embodiment of FIG. 1.

Referring to FIG. 2, there is shown gauge 14 provided with a face 22 which may be conveniently viewed by diver 10 at any time during the course of his dive. Face 22 includes digital readouts 24*a* and 24*b*, each comprising, for example, a liquid crystal display or a light emitting diode display. Digital readout 24*a* shows the maximum depth in feet to which the diver has descended up to any point during the course of his dive, and readout 24*b* shows the amount of time he has been underwater up to such point, in minutes. Face 22 is further provided with an indicator light 24*c* which is illuminated when the voltage of a battery providing the power for gauge 14 has become insufficient to enable reliable operation of gauge 14.

Referring further to FIG. 2, the gauge is provided with a compartment 26 into which an integrated circuit element 28 may be removably inserted. Element 28 is retained in compartment 26 by means of a threaded plug 30, and is a solid state electronic device that couples the activating signal to a bone conduction earphone, or other audio alarm, when the diver descends below a particular limiting depth. The integrated circuit element is one of a set of like integrated circuit elements, each of which is removably insertable into the compartment, and which corresponds to a different limiting depth 12. By providing such set of elements, the gauge may be structured to activate alarm at a specified depth simply by selecting a specified integrated circuit element which corresponds thereto, and then inserting such selected into compartment 26. Each integrated circuit element is very stable and comparatively inexpensive to manufacture. By means of such set of integrated circuit elements, the gauge is made adaptable for use over a wide range of maximum depths without the need for an adjustable control device that could wear with repeated use, and introduce unpredictable errors.

Referring again to FIG. 2, the gauge is provided with a pressure transducer device 32, which generates an analog voltage signal in relation to the pressure upon it. The transducer is calibrated so that its output voltage $V_s$ represents the gauge's depth. The gauge is fixably contained in a case 34, which may be secured to a diver's wrist by means of wrist straps 36 or the like.

Figure 3:
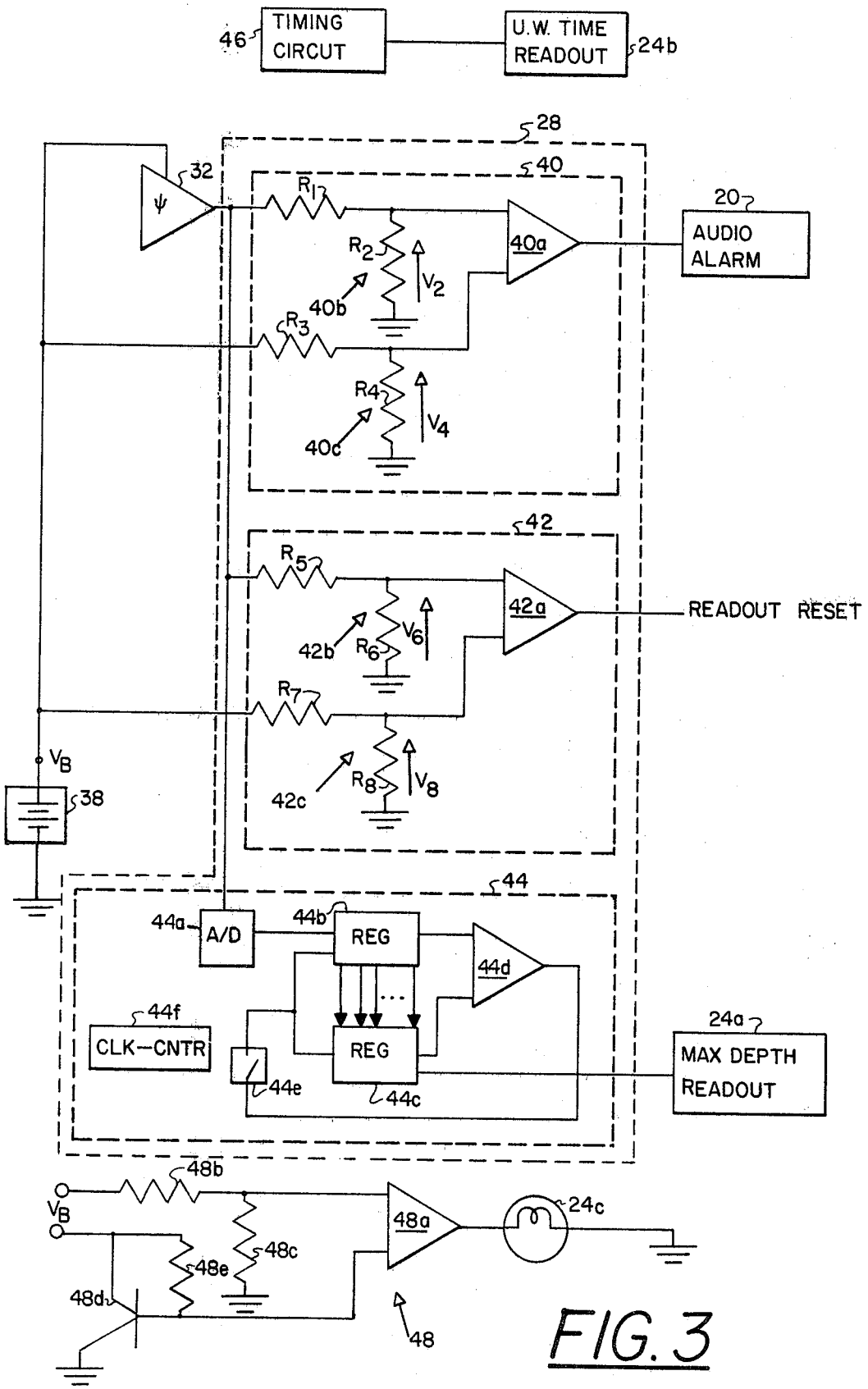
FIG. 3 is a diagram showing various electronic components and their interconnection for the embodiment of FIG. 1.

Referring to FIG. 3, the pressure transducer receives power from a battery 38, which is protectively enclosed within case 34. Battery 38 is selected from a range of commercially available miniature batteries, which are capable of providing sufficient power to operate transducer 32, alarm 20, and other electronic components included in gauge 14 for a period of at least several hours.

Referring further to FIG. 3, integrated circuit element 28 includes an alarm activation circuit 40. Circuit 40 is provided with a comparator 40*a* and with resistance divider networks 40*b* and 40*c*, network 40*b* comprising resistors $R_1$ and $R_2$, and network 40*c* comprising resistors $R_3$ and $R_4$. Network 40*b* receives the analog output voltage of transducer 32, and $V_2$, the portion of such voltage across resistor $R_2$, comprises one of the inputs to comparator 40*a*. In like manner, network 40*c* receives $V_B$, the voltage of battery 38, and $V_4$, the portion thereof across resistor $R_4$, comprises the other input to comparator 40*a*. The output voltage $V_B$ of battery 38, as well as $V_m$, the value of the analog voltage of transducer 32 when the gauge is at a particular maximum depth, are available once specific devices have been selected for battery 38 and transducer 32. Therefore, by judicious selection of respective values for resistors $R_1$–$R_4$, $V_2$ can be made to be less then $V_4$ only when the analog voltage is less than $V_m$. Such condition, it is clear, occurs only when gauge 14 is at a depth less than the above particular maximum depth. When $V_4$ exceeds $V_2$, the output of comparator 40*a* is at a first voltage level, and when $V_2$ exceeds $V_4$, comparator output is at a second voltage level. Consequently, a transition of the output of comparator 40*a* from a first level to a second level indicates that gauge 14 has descended below the above particular maximum depth, and may be employed as an activating signal coupled to audio alarm 20.

FIG. 3 is also provided with a display reset circuit 42, which is very similar to circuit 40 and includes a comparator 42*a* and resistance divider networks 42*b* and 42*c*, comprising resistors $R_5$ and $R_6$, and $R_7$ and $R_8$ respectively. Network 42*b* receives the output of transducer 32, network 42*c* receives the battery voltage, and the inputs to comparator 42*a* comprise voltages $V_6$ and $V_8$, respectively, across resistors $R_6$ and $R_8$. Respective values of resistors $R_5$–$R_8$ are selected so that as long as the diver is below a nominal depth from the surface, such as 5 feet, $V_6$ exceeds $V_8$ and the output of comparator 42*a* is held at a first voltage level. However, when the diver surfaces, $V_6$ becomes less than $V_8$, and the output of comparator 42*a* shifts to a second voltage level. Such second voltage level is coupled to readouts 24*a* and 24*b*, and resets them to display zero or null readings.

By including a reset circuit 42, each integrated circuit element 28 is provided with the capability of automatically preparing gauge 14 for use in a subsequent dive. This eliminates the possibility that a diver will forget to manually reset displays 24*a* and 24*b* after making a first dive.

In order to monitor maximum depth, integrated circuit element 28 is provided with a maximum depth circuit 44, which includes an analog to digital converter 44*a* for continually receiving the analog representation of the current depth of the diver, and converting such analog representation to digital form. Maximum depth circuit 44 further includes digital registers 44*b* and c, comparator 44*d*, and a switch component 44*e*. Components 44*b*–*e* are operated through a succession of cycles under the direction of clock-counter component 44*f*, to update the maximum depth information shown by readout 24*a* each time the diver descends to a new maximum depth during a dive.

At the beginning of one of such cycles, the output of analog to digital converter 44*a*, comprising a digital word representing the depth in feet of diver 10 at the beginning of the cycle, is entered into register 44*b*. Then, each of the digital bits comprising such word is successively applied to an input of comparator 44*d*, proceeding from the most significant bit thereof to the least significant bit. Each time a bit from register 44*b* is applied to comparator 44*d*, a corresponding bit of the digital quantity stored in register 44*c* concurrent therewith is applied to the other input of comparator 44*c*. Such comparison of corresponding bits is continued until all the bits respectively comprising the contents of registers 44*b* and 44*c* have been compared, or until a bit from register 44*b* is at a logic 1 when its corresponding bit from register 44*c* is at logic 0.

It will be readily apparent that the first occurrence of such event provides notice that the digital quantity in register 44*b* is greater than the quantity in register 44*c*. Comparator 44*d* is therefore selected to comprise a device which generates a first voltage level when the input received from 44*b* is less than or equal to the input received from register 44*c*, and which generates a second voltage level when the output from register 44*b* is greater. Consequently, the transition of the output of comparator 44*d* from a first voltage level to a second voltage level during a cycle of operation indicates that the digital contents of register 44*b* are greater than the contents of register 44*c*. Such transition is employed to activate switch component 44*e*, registers 44*b* and *c* and switch 44*e* being so interconnected that activation of switch 44*e* causes the contents of 44*b* to be loaded into register 44*c*.

The aforementioned clock-counter 44*f* is not shown interconnected with the other components of depth monitoring circuit 44. However, it is considered that one of skill in the digital electronic arts will readily perceive the manner in which such interconnections are to be made in order to enable clock-counter 44*f* to direct the operation of circuit 44 through one of the above described cycles. Each cycle is anticipated to have a time duration on the order of milliseconds. Thereby, a diver could not descend to a new maximum depth, and then reascend before such new depth was entered into register 44*c*.

The aforementioned readout reset signal may be employed to clear register 44*c* when the diver surfaces. Consequently, the contents of register 44*c* will be zero at the start of a dive, and during the dive, will store, in digital form, successively greater depths reached by the diver. Register 44*c* is coupled to readout 24*a*, so that the contents of register 44*c* are always displayed upon readout 24*a*.

Referring yet again to FIG. 3, there is shown a timing circuit 46, which is included in gauge 14. Circuit 46 is provided to operate readout 24*b* so that diver 10 is continuously apprised of the amount of time he has been underwater, to a selected degree of accuracy. Electronic timing circuits, such as those employed in digital watches, are considered to be very well known, and to be readily available.

In order to alert a diver to possible errors in the operation of gauge 14 which are caused by the depletion of battery 38, a circuit 48 is included in gauge 14 to activate light 24*c* whenever the voltage of battery 38 drops below a preselected critical value. Such circuit includes a comparator 48*a*, one of the inputs thereto comprising a resistance divider network comprising resistors 48*b* and 48*c*. Circuit 48 further includes a transistor 48*d* and a resistor 48*e*, coupled between battery 38 and the second input to comparator 48*a* as shown in FIG. 3.

Figure 4:
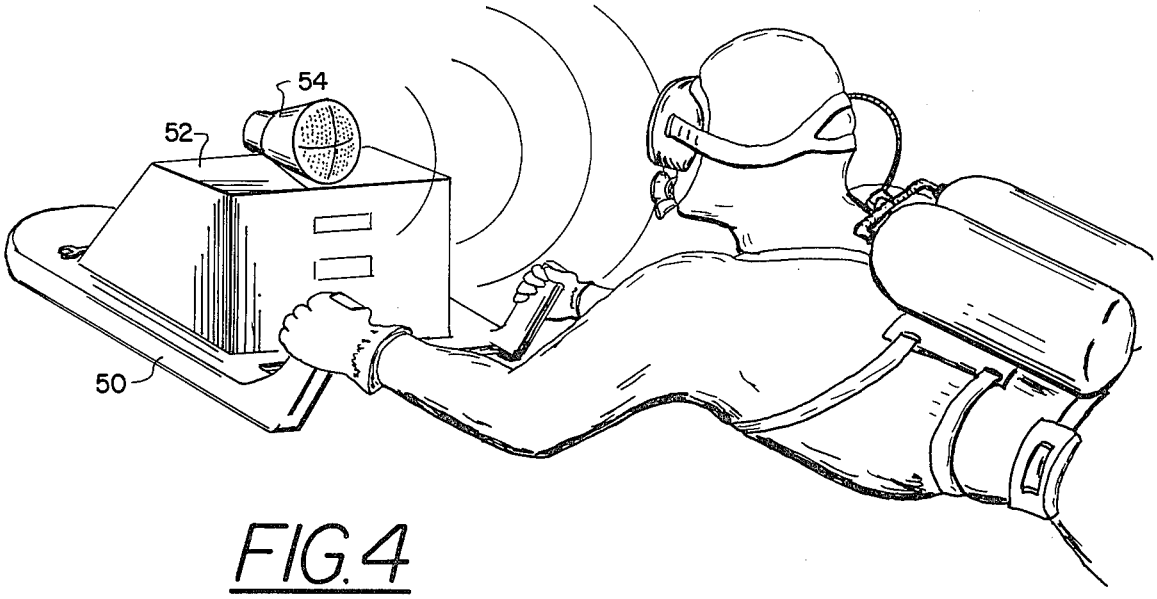
FIG. 4 is a perspective view showing a modification of the embodiment of FIG. 1.

Referring to FIG. 4, a modification of the invention is mountable upon a diver propelled vehicle 50. The electronic components required for the operation of such modification are contained in a package 52, and are similar or identical to the components heretofore described in conjunction with FIG. 3. A battery to power such modification is also contained in package 52. Since a battery which is substantially larger than battery 38 may be used for a DPV mountable modification, sufficient power may be available therefrom to operate an acoustic projector 54, mounted on the DPV, to provide notice to a diver that he has exceeded a preselected maximum depth.

Obviously, many other modifications and variations of the present invention are possible in the light of the above teachings. It is therefore to be understood that within the scope of the appended claims the invention may be practiced otherwise than as specifically described.

What is claimed is:

1. An apparatus for diver safety comprising:

a package sized to be mountable upon a diver's wrist;

solid state electronic depth monitoring means for monitoring the maximum depth of a diver during the period that the diver is submerged being disposed in the wrist mountable package;

indicating means disposed in the wrist mountable package coupled to said depth monitoring means for enabling said diver to readily determine at any given time during said period his maximum depth of submergence; and an audio alarm means coupled to said depth monitoring means for alerting said diver when said diver descends below a preselected critical maximum depth, said audio alarm comprising a bone conduction earphone means electrically connected to said package by a small conductor disposed inside a diver's wetsuit and extending between said earphone means and said package.

2. The apparatus of claim 1 further including:

means disposed in the wrist mountable package for monitoring the passage of time while said diver is submerged;

means disposed in the wrist mountable package coupled to said time monitoring means for displaying said submergence time of said diver; and means disposed in the wrist mountable package coupled to said depth monitoring means for displaying said maximum depth of said diver.

3. The apparatus of claim 2: further including means disposed in the wrist mountable package for automatically clearing said maximum depth display means when said diver surfaces at the conclusion of said submergence period.

4. The apparatus of claim 1 wherein said depth monitoring means is a pressure responsive device for generating a signal which indicates the depth of said diver at a given time during said period of submergence and wherein said apparatus further comprises integrated circuit means receiving said depth indicating signal for activating said audio alarm when said diver descends below said preselected critical depth.

5. The apparatus of claim 4 wherein:

said integrated circuit means is prestructured to respond to a particular one of said depth indicating signals by activating said audio alarm, said integrated circuit means being one of a set of integrated circuits which each correspond to a different depth of submergence and each in said set being removably insertable into said package.

* * * * *